US005542827A

United States Patent [19]

Dombek et al.

[11] Patent Number: 5,542,827

[45] Date of Patent: Aug. 6, 1996

[54] MULTIPLE NESTED PISTONS HAND PRIMING PUMP WITH SPRING BIASING

[75] Inventors: Bruce B. Dombek, Roselle; Theodore F. Boone, Tinley Park, both of Ill.

[73] Assignee: Navistar International Transportation Corp., Chicago, Ill.

[21] Appl. No.: 385,507

[22] Filed: Feb. 8, 1995

[51] Int. Cl.[6] ..... F04B 19/00

[52] U.S. Cl. ..... 417/486; 417/487; 92/52

[58] Field of Search ..... 417/486, 487; 92/52, 53

[56] References Cited

U.S. PATENT DOCUMENTS

| | | | |
|---|---|---|---|
| 1,969,920 | 8/1934 | Andres | 417/487 |
| 2,380,907 | 7/1945 | Hall | 92/52 |
| 2,420,409 | 5/1947 | Bivans et al. | 417/487 |
| 2,434,296 | 1/1948 | Swanson | 417/487 |
| 2,649,842 | 8/1953 | Caldwell | 92/52 |
| 2,831,464 | 4/1958 | Lillquist | 92/52 |
| 3,948,589 | 4/1976 | DuBois | 417/487 |
| 5,065,607 | 11/1991 | Kadis et al. | 92/52 |

FOREIGN PATENT DOCUMENTS

| | | | |
|---|---|---|---|
| 2469578 | 5/1981 | France | 417/487 |

OTHER PUBLICATIONS

Heywood, "Internal Combustion Engine Fundamentals", 1988, p. 30.

*Primary Examiner*—John J. Vrablik
*Assistant Examiner*—Ted Kim
*Attorney, Agent, or Firm*—Dennis K. Sullivan

[57] ABSTRACT

A multiple piston hand priming pump includes a plurality of nested pistons engaged within a hollow cylindrical housing. One end of the housing has an inlet/outlet fitting leading to a pumping chamber defined within the housing and the other end of the housing is closed. Through a center bore in the closed end of the housing, a plunger activating rod extends into communication with the centermost piston of the nested plurality of pistons. The nested pistons each engage within the next circumferential piston in a manner forming a lost motion connection therewith at the end of an axial bore in the next piston to cause sequential actuation after the pumping stroke of the inner piston is completed.

12 Claims, 2 Drawing Sheets

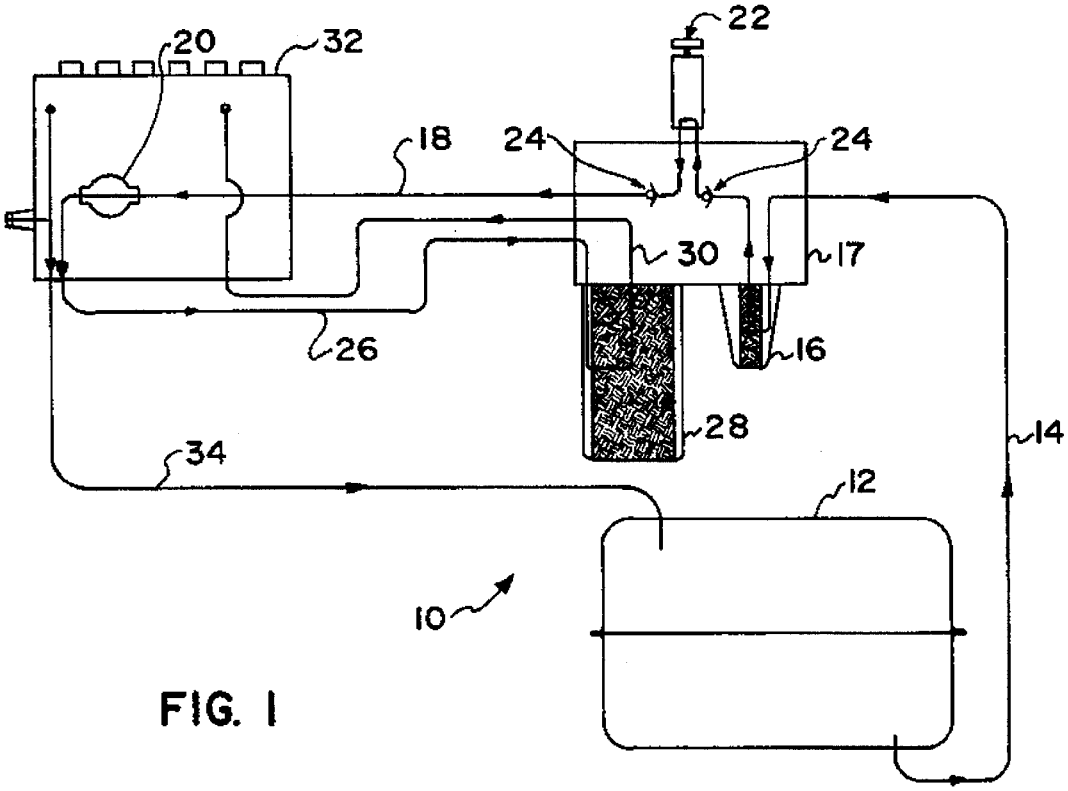
FIG. 1
FIG. 2
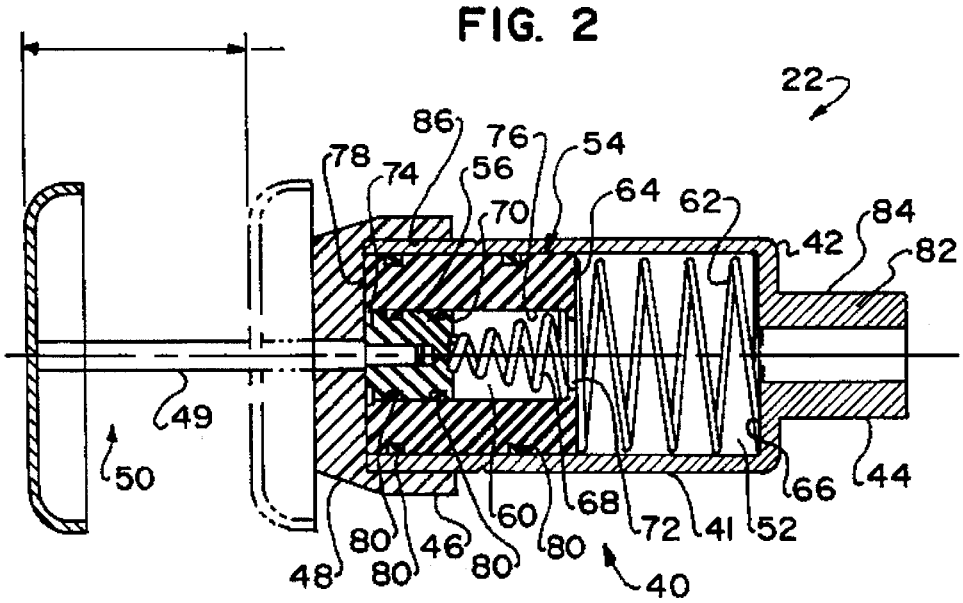

MULTIPLE NESTED PISTONS HAND PRIMING PUMP WITH SPRING BIASING

BACKGROUND OF THE INVENTION

The present invention relates to a hand priming pump of the type used in priming a fuel system in a diesel engine and, more specifically, to a pump including multiple pistons therein disposed in a nested configuration, thereby offering large displacement capability as well as small displacement capability for easier pumping as the system being primed becomes pressurized.

THE PRIOR ART

Heretofore various styles of single piston hand priming pumps have been proposed for use in priming diesel engine fuel systems. Such single piston priming pumps require increasing physical force to be applied thereto as the fuel system becomes pressurized. In certain fuel systems, the pressure increase is produced by internal check valves in the system necessary for maintaining hydraulic performance during engine operation. In any event, a point may be reached where continued priming is no longer possible because the pressure in the fuel system cannot be overcome manually using only a single large piston within the priming pump.

SUMMARY OF TEE INVENTION

Accordingly, it is a primary object of the priming pump of the present invention to provide a priming pump which can be easily operated to prime a system that has become pressurized during priming.

It is a further object of the invention to provide a priming pump having multiple nested pistons therein wherein innermost piston will be actuable even if actuation of an outer piston is prevented by high back pressure in the system to allow for continued hand priming even under high pressurization of the system.

These as well as other objects are specifically met by the multiple piston hand priming pump of the present invention which includes a pumping chamber housing having a first piston therein wherein the first piston has an axial bore in which a smaller second piston is contained. A plunger operates the second piston in the axial bore until the second piston engages the first piston through a lost motion connection at the end of the pumping stroke of the second piston. Thereafter, continued movement of the plunger actuates the larger first piston with its larger displaced volume to provide quick filling during low pressure beginning priming strokes. Near the end of priming, the first piston no longer be manually actuable due to high back pressure in the fuel system. At this point, the second smaller piston may still be actuated without actuating the first piston to complete the priming. Each piston is provided with its own return spring to provide more convenient operation.

BRIEF DESCRIPTION OF THE DRAWINGS

Other objects and advantages of the invention will become more apparent upon perusal of the detailed description thereof and upon inspection of the drawings in which:

FIG. 1 is a schematic diagram of a fuel system of a diesel engine and shows the priming pump of the present invention engaged functionally thereto.

FIG. 2 is an enlarged longitudinal cross sectional view through the pump of FIG. 1.

DESCRIPTION OF THE PREFERRED EMBODIMENT

Figure 7:
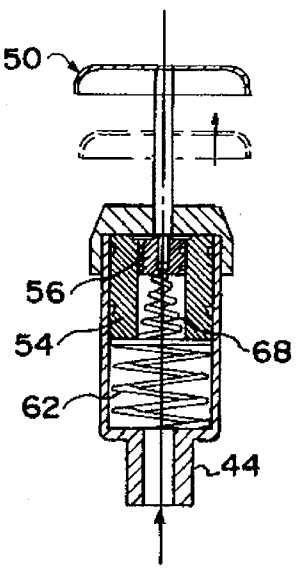
FIGS. 3–7 show sequential movement of the pistons of the pump through one entire stroke, where both the primary and secondary pistons are deployed, such as during early phase priming of a closed system.

Referring now to the drawings in greater detail, there is illustrated in FIG. 1 a schematic representation of a vehicle fuel system 10 utilizing a diesel engine.

The fuel system 10 includes a fuel tank 12 to which is connected a fuel supply line 14 feeding a fuel precleaner strainer 16. Installed in a supply line 18 leading from the strainer 16 to a fuel transfer pump 20 for the engine is a multiple piston hand priming pump 22 made in accordance with the teachings of the present invention.

To assure that the priming pump 22 creates only a one way flow of fuel toward the transfer pump 20, one-way check valves 24 are disposed each side of the pump to maintain the direction of fuel flow. Although one or both check valves 24 could be included as part of the priming pump or elsewhere in the fuel system 10, here they are incorporated in a filter header 17 for the strainer 16 to which the pump 22 is mounted.

Fuel is fed from the transfer pump 20 through a line 26 to a final fuel filter 28 of the system 10 from which fuel is transported through a line 30 into an injection pump 32 of the system 10, with unused fuel in the pump 32 being returned to the tank 12 through a line 34.

Priming of the system 10 becomes necessary under various known conditions, for example, injection pump replacement. During such priming, fuel is moved into and through the system 10 from the tank 12, with air in the system 10 eventually ending up in the tank 12. It will be understood that, as the system 10 is primed, the pressure therein increases as air is displaced with fuel, increasing the mass of fluid to be moved through the system, thereby making operation of a hand pump more difficult with each stroke against the increasing pressure.

In accordance with the invention, the hand pump 22 includes multiple pistons which may act singly or sequentially to provide easy priming under either high or low pressure conditions. As shown in FIG. 2, the pump 22 includes a housing 40 having a hollow cylindrical body 41 which terminates at one end 42 in an inlet/outlet fitting 44, a cap 46 closing the opposite end 48. A rod 49 of a manually operable plunger 50 is slidably mounted in and extends axially into a primary hollow interior pumping chamber 52 of the pump 22 defined within the housing 40.

Within the pumping chamber 52 of the pump 22, in the embodiment shown, are first and second pistons 54 and 56 disposed in a nested arrangement, the first piston 54 being the outermost and slidably disposed within the chamber 52. The piston 54 is cylindrical and is provided with an axial bore 60, defining therewithin a second pumping chamber, within which the second piston 56 is slidably mounted.

Turning to the first piston 54, it will be seen that the first piston 54 extends less than the full length of the chamber 52 and is biased away from the inlet/outlet fitting 44 of the housing 40 against the cap 48 by a coiled return spring 62. As shown, the spring 62 is contained within the primary pumping chamber 52 and is biased between an end wall 64 of the first piston 54 and an inwardly stepped end wall 66 of the housing 40 formed between the cylindrical wall and the inlet/outlet fitting 44.

The first piston 54 is not directly connected to the plunger 50 but rather is acted upon by the second piston 56, which is attached to the plunger rod 49, by a lost motion connection permitting relative movement between the pistons which may be taken up at the end of the stroke of the second piston 56 within the bore 60.

To accomplish this lost motion connection, an inwardly directed circumferential rib 72 is provided at the end of the axial bore 60 in the first piston 54. A second return spring 68 is disposed between the rib 72 and the second piston 56 to bias the piston 54 toward the capped return or plunger end 48 of the housing 40. Also, a stop ring 74 is provided in an interior groove 76 of the first piston 54 adjacent the closed end 78 thereof, to keep the second piston 56 from becoming disengaged therefrom should the plunger be retracted more quickly than the piston 54 retracts.

Figure 6:
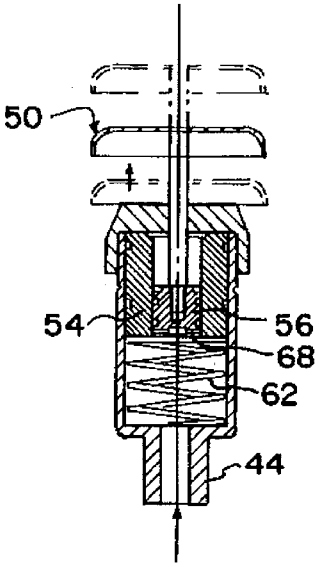
Figure 5:
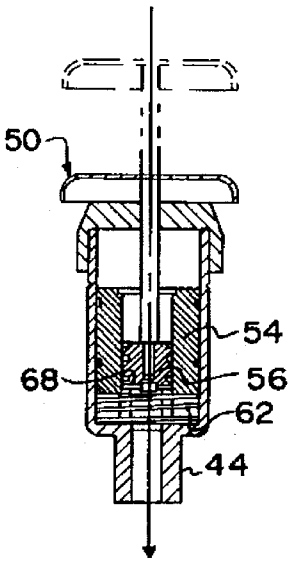
Figure 4:
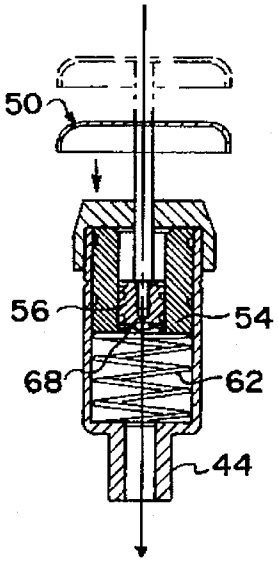

The configurations of the return springs 62 and 68 are nonuniform. In this respect, it will be seen that the spring 62 is a cylindrical helix 62, with the coils thereof resting contiguous to each other when the spring 62 is compressed as shown in FIG. 5. On the other hand, the spring 68 is configured as a conical helix 68, with coils thereof decreasing in diameter so that a single thickness coil is produced when the spring 68 is compressed, as shown in FIGS. 4–6. The spring 68 is configured as a conical helix 68 so that maximum displacement and volume can be pumped with each stroke of the second piston 56.

As stated above, when a closed system such as a fuel system 10 is being primed, the back pressure within the system 10 increases as fuel replaces air, thereby making manual plunger activation more difficult with each stroke when only one piston is provided. This is because the volume displaced with each plunger stroke remains constant. If such displaced volume could be significantly decreased when pressure significantly increases within the system, priming could continue. This is exactly what is accomplished with the multiple piston hand priming pump 22 of the present invention.

In this respect, as shown in FIGS. 3 through 7, when priming is first begun, first piston 54 and second piston 56 may both be activated sequentially, depending on the relative forces required to overcome the springs 62 and 68, as will be explained below, and so long as pressure within the system does not produce a pressure resistance great enough within the pumping chamber 52 to keep the first piston 54 from moving thereagainst.

Up to such increased pressure point, and assuming the smaller spring 68 is weaker than the larger spring 62, when the plunger 50 is activated, the second piston 56 is first activated, being moved toward the end 64 of the first piston 54, until the spring 68 is completely compressed to totally take up the lost motion connection between the second piston and the first piston. Thereafter, the second piston 56 applies pressure through the lost motion connection against the circumferential rib 72 of the first piston 54. First piston 54 then moves against the spring 62, terminating its travel at a point as shown in FIG. 5 where end 64 of the first piston 54 rests against the tightly coiled spring 62. When the downward stroke of the plunger 50 is completed, if the plunger 50 is released, the return springs 62 and 68 act to return the primary and second pistons 54 and 56, respectively, to their start of stroke positions shown in FIG. 3. However, under manual control, the plunger can be allowed to retract only far enough to return the first piston 54, to repeat the operation of the first piston 54 only for high volume pumping early in the priming cycle.

In either case, this repetition continues until pressure in the system 10 increases to a point where activation of the first piston 54 is beyond manual capability and the shorter strokes of the plunger 50 are all that can be manually accomplished, moving only the second piston 56, as illustrated in FIG. 4, generating continued small volume priming until pressure in the system 10 increases to such a point where deployment of the second piston 56 also becomes manually impossible.

The foregoing example assumed that the spring 68 was weaker than the spring 62. An alternative embodiment, wherein the spring 68 is stronger than the spring 62 but is otherwise the same as shown in FIGS. 1 and 2, may be used to advantage to provide a different mode of operation. In the alternative embodiment, when priming is initiated, the plunger 50 will act on the piston 56 and through the uncollapsed spring 68 on the piston 54 to overcome spring 62, thereby allowing both pistons to move in unison toward the inlet/outlet fitting 44 under low pressure conditions, thus utilizing only the larger displaced volume caused by the combined area of both pistons but with a shorter stroke. Although the lost motion connection could then be taken up to permit the additional stroke of the second piston, it may not be desirable to do so as opposed to retracting the plunger for another full volume stroke. When the pressure in the system builds up to the point where the larger first piston can no longer be manually operated, then the second piston would continue to be operated by taking up the lost motion connection within the first piston until the pressure ultimately becomes so high that manual operation is totally impossible.

Figure 3:
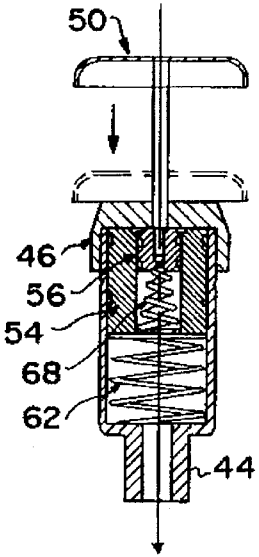

It will be understood that the pump inlet/outlet fitting 44 is fed via the line 14 with fuel which enters the primary and second chambers 52 and 60, respectively upon return of the pistons 54 and 56 to the ready position of FIG. 3 and that fuel is then forced into the line 18 upon activation of the plunger 50, unidirectional flow of the fuel being assured by the provision of the one-way check valves 24 shown in FIG. 1.

To maintain the pump 22 as leak free as possible to generate the highest pressure possible during each stroke of the plunger 50, a plurality of seal rings 80, which may be of the O-ring or U-cup type are provided between structures which move relative to one another, i.e., between the first piston 54 and the housing 40, and between the first and second pistons 54 and 56, respectively. Further, to ensure a tight seal between the fitting 44 of the pump 22 and a bore (not shown) provided in the filter header 17 for receipt of same in the system 10, the engagement between the bore and fitting 44 is made by creating a pipe thread configuration 82 on an outer surface 84 of the fitting 44.

As described above, the multiple piston hand priming pump of the present invention provides a number of advantages, some of which have been described above and others of which are inherent in the invention. Also, in view of the foregoing description, it will be evident to those of ordinary skill in the art that various modifications and alternative embodiments can be made without departing from the inventive teaching herein. For example, although only two pistons are shown in the disclosed embodiment, it will be understood that any number of nested pistons may be provided to suit a particular set of parameters for a given application. Additionally, although the invention has been described in two embodiments which differ only in the relative strengths of the return springs, many other variations in the sequencing of the operation of the pistons depending on the back pressure can be obtained through the selection of differing spring rates and preloads of the return springs. Accordingly, the scope of the invention is only to be limited in accordance with the accompanying claims.

What is claimed is:

1. A multiple piston hand priming pump comprising:

a hollow cylindrical housing having an inlet/outlet opening at one end thereof leading to a pumping chamber defined within the housing, the end of said housing opposite said one end being closed;

a first piston slidably disposed within said pumping chamber for axial movement therein, said first piston having an axial bore;

a first return spring disposed between said housing and said first piston, aid first return spring biassing said first piston toward said closed end of said housing;

a second piston slidably disposed within said axial bore of said first piston and forming a lost motion connection therewith at a first end of said axial bore closer to said inlet/outlet opening; and a second return spring disposed between said first piston and said second piston, said second return spring biassing said second piston toward said closed end of said housing, said first spring being stronger than said second spring;

a manual actuator for both pistons, said actuator slidably mounted in and extending axially through said closed end of the housing and having an end thereinside in engagement with said second piston.

2. The pump of claim 1 and a diameter of said inlet/outlet opening being smaller than an inner diameter of said housing to define a shoulder of the housing surrounding the inlet/outlet opening, said first return spring biasing said first piston seats being disposed between one end of the piston and said shoulder.

3. The pump of claim 2 wherein said axial bore in said first piston is formed with an integral circumferential retaining rib disposed on an inner surface there adjacent said first end of said bore, said second return spring being disposed between said second piston and said circumferential retaining rib.

4. The pump of claim 1 wherein said manual actuator comprises a plunger.

5. The pump of claim 4 wherein said second piston is attached to said plunger and is freely movable within said axial bore defined within the first piston.

6. The pump of claim 1 and said first piston having an end closer to said inlet/outlet opening having a surface area larger than the surface area of said second piston and said housing pumping chamber having a sufficient axial length to permit a greater displacement of said first piston therein than said second piston displacement in said axial bore.

7. The pump of claim 1 wherein seal rings are disposed between said first and second pistons.

8. The pump of claim 7 wherein seal rings are engaged between said first piston and said housing.

9. The pump of claim 1 wherein said closed end of said housing includes a cap member which is threadedly attached to the exterior surface of said pump housing.

10. The pump of claim 9 wherein said cap has a center bore therein through which said manual actuator extends into engagement with said second piston.

11. A multiple piston hand priming pump comprising:

a hollow cylindrical housing having an inlet/outlet fitting at one end thereof defining an opening leading to a pumping chamber within the housing, the end of said housing opposite said one end having a cap threadedly attached thereto to close said housing thereat;

a first piston slidably disposed within said pumping chamber for axial movement therein, said first piston having an axial bore;

a first return spring disposed between said fitting end of said housing and said first piston;

a second piston slidably disposed within said axial bore of said first piston;

a second return spring disposed in said axial bore between said first end thereof and said second piston, said first spring being stronger than said second spring, said second piston forming a lost motion connection with said first piston upon said second return spring completely collapsing, said first piston being moved by said second piston only through said lost motion connection; and a manual actuator for both pistons, said actuator slidably mounted in and extending axially through said housing cap and having an end thereinside in engagement with said second piston.

12. In combination with a diesel engine fuel system including at least a fuel tank and a fuel injection device, fuel traveling to said device from said tank and unused fuel being returned to said tank from said device with the fuel traveling through fuel lines, a multiple piston hand priming pump comprising:

a hollow cylindrical housing having an inlet/outlet fitting at one end thereof leading to a pumping chamber defined within the housing, said housing fitting opening into a fuel pathway leading from the fuel tank to the fuel injection device and the housing having a closed axial end;

a first piston slidably disposed within said pumping chamber for axial movement therein, said first piston having an axial bore;

a first return spring disposed to bias said first piston toward the closed end of said housing and said first piston;

a second piston slidably disposed within said axial bore of said first piston and forming a lost motion connection therewith at a first end of said axial bore closer to said inlet/outlet opening;

a second return spring disposed to bias said second piston toward the closed end of said housing, said first spring being stronger than said second spring; and a manual actuator for the pistons extending through the closed end of the housing and engaging said second piston; said fuel pathway, including one-way check valves both upstream and downstream of said pump to cause one way travel of fuel within the fuel system.

* * * * *